US010246215B2

(12) United States Patent
Greenfeld

(10) Patent No.: US 10,246,215 B2
(45) Date of Patent: Apr. 2, 2019

(54) SEMIREGULAR POLYHEDRON BOX AND METHOD OF ASSEMBLY

(71) Applicant: Mutty Greenfeld, Brooklyn, NY (US)

(72) Inventor: Mutty Greenfeld, Brooklyn, NY (US)

( * ) Notice: Subject to any disclaimer, the term of this patent is extended or adjusted under 35 U.S.C. 154(b) by 154 days.

(21) Appl. No.: 15/486,384

(22) Filed: Apr. 13, 2017

(65) Prior Publication Data

US 2018/0297743 A1 Oct. 18, 2018

(51) Int. Cl.
*B65D 5/00* (2006.01)
*B65D 5/10* (2006.01)
*B65D 5/468* (2006.01)

(52) U.S. Cl.
CPC ..... *B65D 5/10* (2013.01); *B65D 5/4608* (2013.01)

(58) Field of Classification Search
CPC ..... B65D 5/2033; B65D 5/10; B65D 5/06; B65D 5/0025; B65D 5/0254
USPC ..... 229/109, 108, 124, 186–188
See application file for complete search history.

(56) References Cited

U.S. PATENT DOCUMENTS 4,119,266 A * 10/1978 Dempster ..... B65D 5/029 229/109
4,260,100 A * 4/1981 Hoffman ..... B65D 5/0254 229/109
4,361,267 A * 11/1982 Wozniacki ..... B65D 5/10 229/109
4,392,607 A * 7/1983 Perkins, Jr. ..... B65D 5/10 229/109
4,702,408 A * 10/1987 Powlenko ..... B65D 5/10 229/101
5,046,662 A * 9/1991 Cowles ..... B65D 5/10 229/156
5,139,196 A * 8/1992 Fry ..... B65D 5/10 229/109
5,305,950 A * 4/1994 Oppenheim ..... B65D 5/10 229/157
5,533,666 A 7/1996 Cromwell
5,628,450 A 5/1997 Cromwell et al.
5,630,543 A * 5/1997 Dugan ..... B65D 5/3628 229/109
5,878,946 A * 3/1999 Frerot ..... B65D 5/46192 229/117.13
7,717,838 B2 * 5/2010 Strong ..... B65D 5/722 493/126

(Continued)

*Primary Examiner* — Brian D Nash
(74) *Attorney, Agent, or Firm* — Vincent G. LoTempio; Kloss, Stenger & LoTempio; David T. Stephenson

(57) ABSTRACT

A semiregular polyhedron box and method of assembly provides a rectangular cross-section, ten faces, twenty-four edges, and sixteen vertices. The box is plastic corrugated and has two rectangular sidewalls, two square sidewalls, and four corner sidewalls. The sidewalls join at their lateral edges to form an enclosed region defined by a generally rectangular shape and four chamfered edges. Four rectangular panels hingedly join two opposing upper edges of rectangular sidewalls. Each rectangular panel has two L-shaped slots. Four irregular panels hingedly join two opposing upper and lower edges of the square sidewalls. Each irregular panel comprises an irregular top edge having a convex curve, and top angled corners. Each irregular panel also comprises irregular lateral edges having a lateral notch and bottom angled corners. The top angled corners of the irregular top edge and lateral notch detachably interlock with the L-shape slots of the rectangular panel to close the box.

18 Claims, 11 Drawing Sheets

(56) References Cited

U.S. PATENT DOCUMENTS

| | | | | |
|---|---|---|---|---|
| 8,777,094 | B2 * | 7/2014 | Strong | B65D 5/029 229/109 |
| 8,985,431 | B2 * | 3/2015 | Smith | B65D 5/42 229/109 |
| 9,527,622 | B2 | 12/2016 | Carman | |
| 9,789,993 | B2 * | 10/2017 | Smith | B65D 5/029 |
| 10,086,579 | B2 * | 10/2018 | Armstrong | B65D 5/0015 |

* cited by examiner

SEMIREGULAR POLYHEDRON BOX AND METHOD OF ASSEMBLY

FIELD OF THE INVENTION

The present invention relates generally to a semiregular polyhedron box and method of assembly. More so, the present invention relates to a plastic corrugated box that follows a generally semiregular polyhedron-shaped box and that assembles from a collapsed, flat sheet to an assembled three-dimensional container that is defined by 10 faces, 16 vertices, and 24 edges—four of which are chamfered edges; whereby the box has two rectangular sidewalls, two square sidewalls, and four corner sidewalls that join at lateral edges to form an enclosed region having a generally rectangular shape with chamfered corners; whereby the sidewalls are defined by lateral edges, upper edges, and lower edges; whereby four rectangular panels hingedly join with two opposing upper edges of the rectangular sidewalls, each rectangular panel defined by a top edge, a pair of lateral edges, and a bottom edge that hingedly joins the upper edge of the rectangular sidewall, each rectangular panel further defined by two L-shaped slots that are disposed in a spaced apart relationship; whereby four irregular panels hingedly join with two opposing upper edges of the square sidewalls, each irregular panel defined by an irregular bottom edge that hingedly joins the upper edge of the square sidewall, each irregular panel further defined by an irregular top edge having a convex curve with a central notch and a pair of top angled corners, each irregular panel further defined by a pair of irregular lateral edges having a lateral notch and a bottom angled corner; whereby the pair of top angled corners and the lateral notch are sized and dimensioned to detachably interlock with the two L-shape slots of the rectangular panel, so as to temporarily close the box; and whereby the four irregular panels are further defined by an elongated perforation disposed lengthwise to enable folding, so as to facilitate interlocking the panels.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Typically, corrugated boxes are a type of container that used for storage and shipping. These boxes provide some measure of product protection by themselves but often require inner components such as cushioning, bracing and blocking to help protect fragile contents. The boxes are designed to protect potential damage to the contents. For example, boxes unitized into a unit load on a pallet do not encounter individual handling while boxes sorted and shipped through part of their distribution cycle as mixed loads or express carriers can receive severe forces that damage the boxes. Moisture and debris are also inhibited from the object while inside the box.

It is known in the art that a corrugated fiberboard is a material consisting of a fluted corrugated sheet and one or two flat linerboards. It is made on "flute lamination machines" or "corrugators" and is used in the manufacture of shipping containers and corrugated boxes. The corrugated medium and linerboard board both are made of kraft containerboard, a paperboard material usually over 0.01" thick.

Other proposals have involved corrugated boxes. The problem with these containers is that they do not provide access from both the top and bottom openings. Also, the structural integrity does not benefit from a semiregular polyhedron shape defined by chamfered edges, 10 faces, 24 edges, and 16 vertices, so as to enhance structural integrity of the box when carrying loads or being stacked. Even though the above cited corrugated containers meet some of the needs of the market, a semiregular polyhedron box and method of assembly that provides a novel construction utilizing eight lateral faces for reinforced structural integrity; opposing top and bottom panels that fold independently of each other to create dual sided-packing features; and interlocking notches and slots that securely, yet temporarily secure the box in a closed position when loaded with objects is still desired.

SUMMARY

Illustrative embodiments of the disclosure are generally directed to a semiregular polyhedron box and method of assembly. The semiregular polyhedron box provides a storage and shipping container having a generally rectangular cross-section with all sidewalls and panels flat, so as to pack materials. When fully assembled, the box is defined by 10 faces, 16 vertices, and 24 edges—of which four edges are chamfered.

The semiregular polyhedron box is defined by a unique sidewall construction that utilizes three different dimensions of sidewalls, which adds strength to the vertices and chamfered corners of the box, eliminating the need for fastening mechanisms to reinforce the vertices and corners of the box. Additionally, this unique semiregular polyhedron design is shaped for easy assembly and for firm support at the corners.

In addition to this feature, corners of the folding panels and L-shaped slots formed in the folding panels interlock so that the cross sectional strength of the box is incorporated by having the corners snap into the slots in the box itself. This serves to significantly increase the strength of the sidewalls and panels on each of the corners when the box is fully assembled without additional support means. The box also collapses to a flat sheet when not operational for facilitated stowage and transporting.

In some embodiments, the semiregular polyhedron box may include a plastic corrugated container that assembles to a generally semiregular polyhedron-shaped box, and that can be easily folded from a collapsed, flat sheet to an operational, three-dimensional container that is defined by 10 faces, 16 vertices, and 24 edges—of which, four edges are chamfered.

The semiregular polyhedron box has two rectangular sidewalls, two square sidewalls, and four corner sidewalls. The sidewalls are defined by lateral edges, upper edges, and lower edges. The sidewalls join at their lateral edges to form an enclosed region defined by a generally rectangular shape and having four chamfered edges. Each corner sidewall, which is generally narrow, is disposed between the wider rectangular and square sidewalls.

In some embodiments, four rectangular panels hingedly join with two opposing upper edges of the rectangular sidewalls. Each rectangular panel is defined by a straight top edge, a pair of straight lateral edges, and a straight bottom edge that hingedly joins the upper edge of the rectangular sidewall. Each rectangular panel is further defined by two L-shaped slots that are disposed in a spaced apart relationship.

In some embodiments, four irregular panels hingedly join with two opposing upper edges of the two square sidewalls, and two opposing lower edges of the two square sidewalls. Each irregular panel is defined by an irregular bottom edge that hingedly joins the upper edge of the square sidewall. Each irregular panel is further defined by an irregular top edge having a convex curve with a central notch. The irregular top edge also has a pair of top angled corners. Further, each irregular panel is defined by a pair of irregular lateral edges having a lateral notch and a pair of bottom angled corners.

In this manner, the pair of top angled corners of the irregular top edge and the lateral notch are sized and dimensioned to interlock with the two L-shape slots of the rectangular panel to temporarily close the box. In some embodiments, the four irregular panels may further be defined by an elongated perforation disposed lengthwise to enable folding. This folding manipulation facilitates interlocking the panels during assemblage of the box. The elongated perforation is generally more proximal to the irregular bottom edge than the irregular top edge.

One objective of the present invention is to provide a corrugated paper box corner construction with sufficient strength so as to be self-supporting and require no additional support means.

Another objective is to provide a semiregular polyhedron box having 10 faces, 24 edges (4 chamfered edges), and 16 vertices when fully constructed.

Yet another objective is to provide three different dimensions of sidewalls, so as to enhance the strength of the vertices and corners of the box; thereby eliminating the need for metallic staples and cloth tape to reinforce the vertices and corners of the box.

Yet another objective is to enhance structural integrity through use of the rounder edges formed by the corner sidewalls that are disposed between the rectangular sidewalls and the square sidewalls.

Yet another objective is to provide geometric corners that interlock with L-shaped slots to reinforce the vertices and corners of the fully constructed box, but also easily disengage for returning the box to the flat, sheet configuration.

Yet another objective is to provide a corrugated paper box corner structure which is adaptable to speedy assembly.

Yet another objective is to provide additional means to hold the corner structure exact when assembled.

Yet another objective is to furnish a box construction blank with simple peripheral configuration which enables like blank to be cut with but a minimum of scrap material.

Other systems, devices, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims and drawings.

BRIEF DESCRIPTION OF THE DRAWINGS

The invention will now be described, by way of example, with reference to the accompanying drawings, in which.

Like reference numerals refer to like parts throughout the various views of the drawings.

DETAILED DESCRIPTION OF THE INVENTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Specific dimensions and other physical characteristics relating to the embodiments disclosed herein are therefore not to be considered as limiting, unless the claims expressly state otherwise.

A semiregular polyhedron box 100 and method 200 of assembly is referenced in FIGS. 1-12. The semiregular polyhedron box 100, hereafter "box 100", provides a novel plastic corrugated box 100 construction utilizing eight lateral faces for reinforced structural integrity; opposing top and bottom panels that fold independently of each other to create dual sided-packing features; and interlocking notches and slots that securely, yet temporarily secure the box in a closed position when loaded with objects.

The sidewalls 102*a-b*, 110*a-b*, 120*a-d*, panels 130*a-d*, 140*a-d*, and interlocking slots 138*a-h* and notches 154*a-h* are flat when the box 100 is collapsed. Yet, when fully assembled, the box 100 forms a generally rectangular cross-section. The method 200 for assembly is relatively straight forward, as the box 100 is manipulated to a generally rectangular, upright position, the panels on both open ends are folded down and interlocked through use of an irregular edge having a notch 154*a*, and an L-shaped slot 138*a*.

Figure 1:
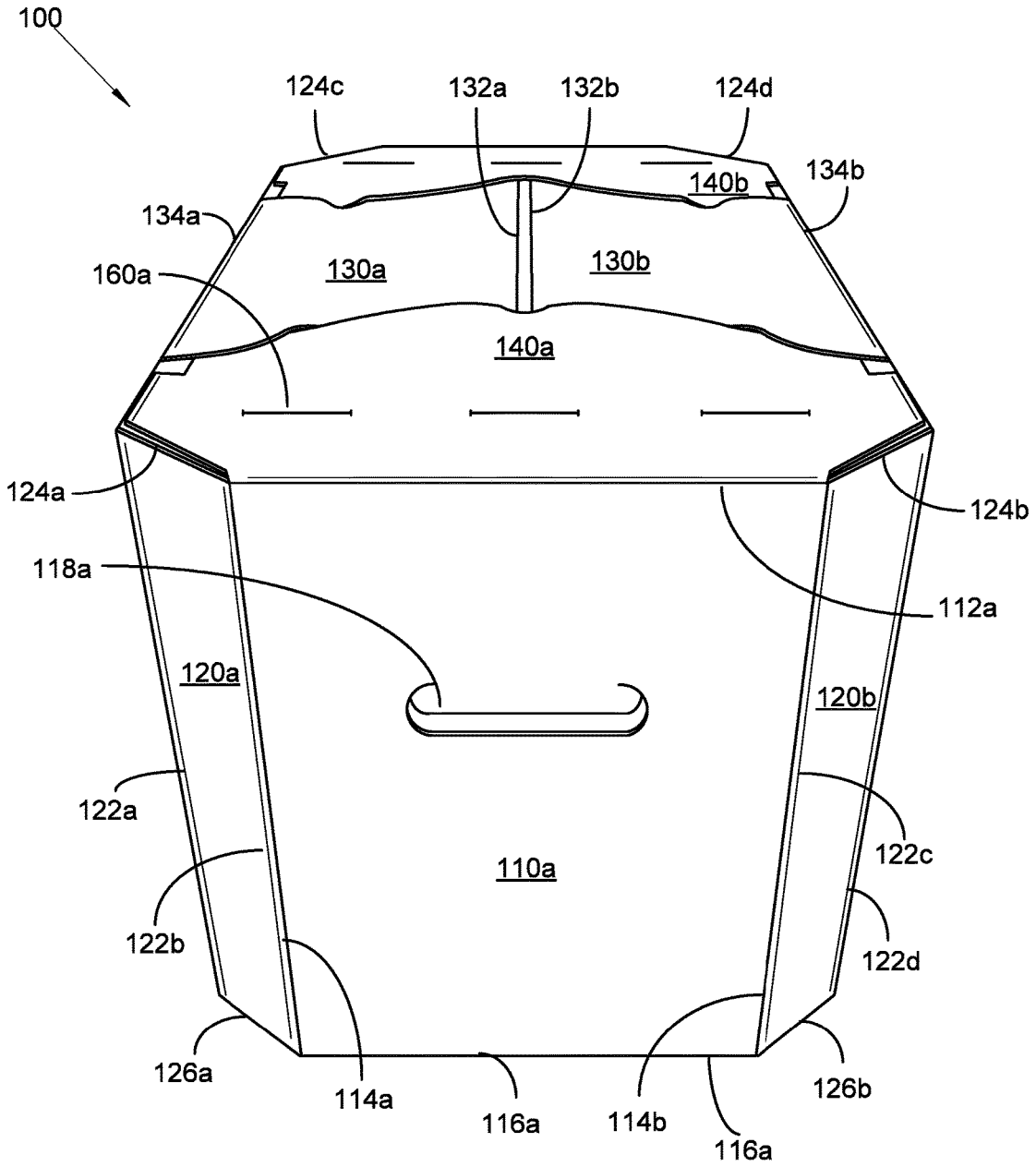
FIG. 1 illustrates a perspective view of an exemplary semiregular polyhedron box fully constructed with two rectangular panels and two irregular panels interlocked, in accordance with an embodiment of the present invention.

As referenced in FIG. 1, the fully assembled configuration of the box 100 is defined by 10 faces, 16 vertices, and 24 edges—of which, four edges are chamfered 158*a-d*. This unique polyhedron three-dimensional shape of the box 100 facilitates assemblage, while also providing firm support at the corners, where structural integrity is often weakest. In one embodiment, the fully assembled box is generally rectangular cross section. Though in other embodiments, the cross section has a generally square shape.

Additionally, the box 100 provides a unique sidewall construction that utilizes three different dimensions of sidewalls arranged in a generally rectangular shape with chamfered corners, which adds strength to the vertices and corners of the box 100. This helps reduce the need for fastening mechanisms, such as metallic staples and cloth tape to reinforce the vertices and corners of the box 100. This also creates a box 100 with greater vertical and lateral support than prior art designs.

In addition to this feature, top angled corners 150*a*, 150*b*, 150*c*, 150*d* and lateral notches 154*a*, 154*b*, 154*c*, 154*d*, 154*e*, 154*f*, 154*g*, 154*h* that form on the edges 144*a-d*, 152*a-h* of a folding irregular panel 140*a* align and interlock with L-shaped slots 138*a*, 138*b*, 138*c*, 138*d*, 138*e*, 138*f*, 138*g*, 138*h* formed in corresponding rectangular panels 130*a-d*. In this arrangement, the cross sectional strength of the box 100 is incorporated by having the corners snap into the slots in the box 100 itself. This unique interlocking mechanism serves to significantly increase the strength of box 100 when fully assembled and closed. The interlocking mechanism also works to provide additional rigidity to sidewalls 102*a-b*, 110*a-b*, 120*a-d* and panels 130*a-d*, 140*a-d* on each of the corners when the box 100 is fully assembled without additional support means.

Further, the box 100 can better support vertical and lateral loads, such as are present when many like box 100*es* are stacked in a column, making box 100 ideal for packaging and shipping heavy objects, fragile goods, and easily damaged produce, for example. And, as described above, box 100 collapses to a flat sheet when not operational for facilitated stowage and transporting.

In some embodiments, box 100 may include corrugated sidewalls 102*a-b*, 110*a-b*, 120*a-d* and panels 130*a-d*, 140*a-d*. Those skilled in the art will recognize that corrugated cardboard boxes are well known and are commonly used to store and ship various goods such as produce. Such boxes are typically made from a single sheet of corrugated cardboard, referred to as a blank that is cut, scored, and then folded along the score lines into a certain shape where it is then glued or otherwise held together.

Figure 2:
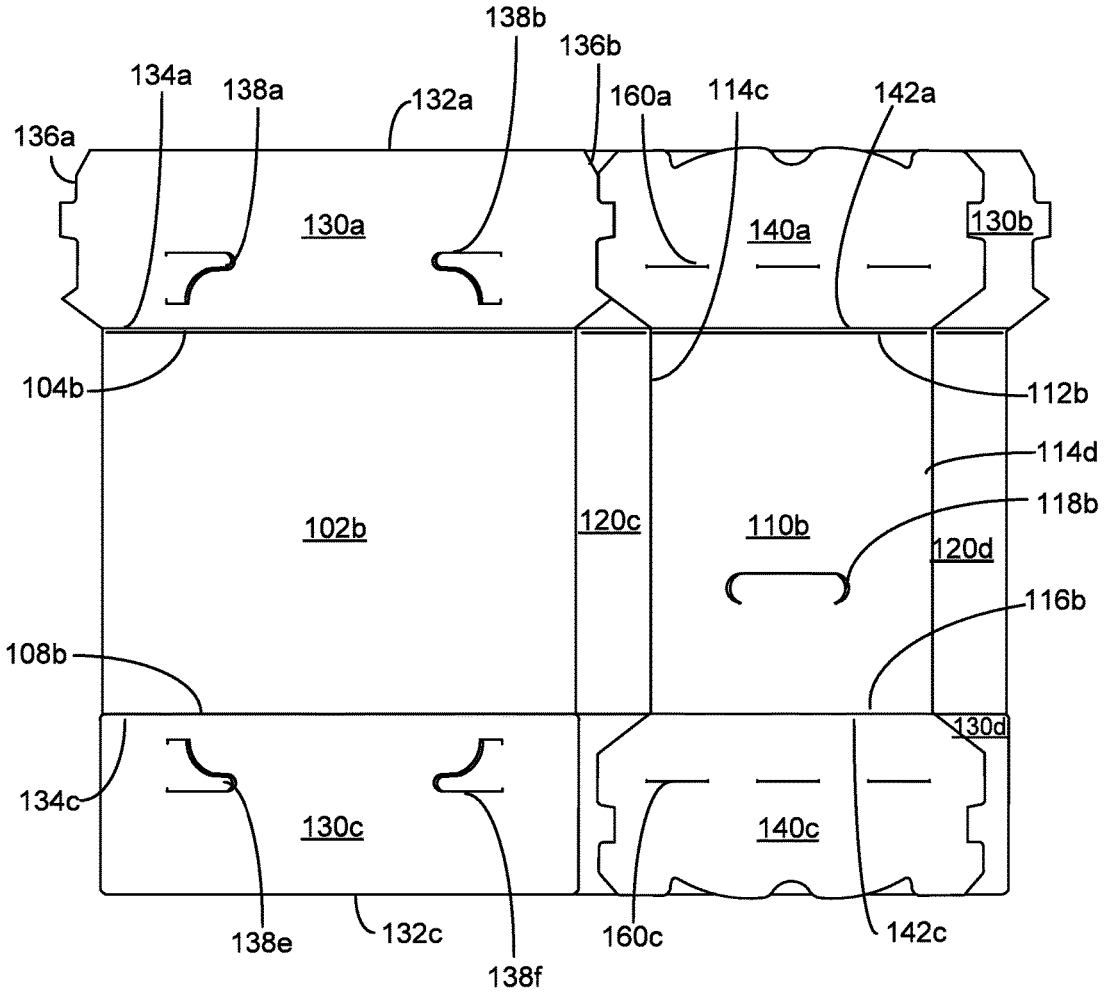
FIG. 2 illustrates a perspective view of the semiregular polyhedron box in FIG. 1, shown in a fully collapsed position, in accordance with an embodiment of the present invention.

Looking at the fully collapsed box 100 in FIG. 2, the semiregular polyhedron box 100 has two rectangular sidewalls 102*a*, 102*b*, two square sidewalls 110*a*, 110*b*, and four corner sidewalls 120*a*, 120*b*, 120*c*, 120*d*. Sidewalls 102*a-b*, 110*a-b*, 120*a-d* join at their lateral edges to form an enclosed region 128 defined by a generally rectangular shape and having four chamfered edges 158*a*, 158*b*, 158*c*, 158*d*, with each chamfered edges disposed in a spaced apart equidistant from the other.

Figure 3:
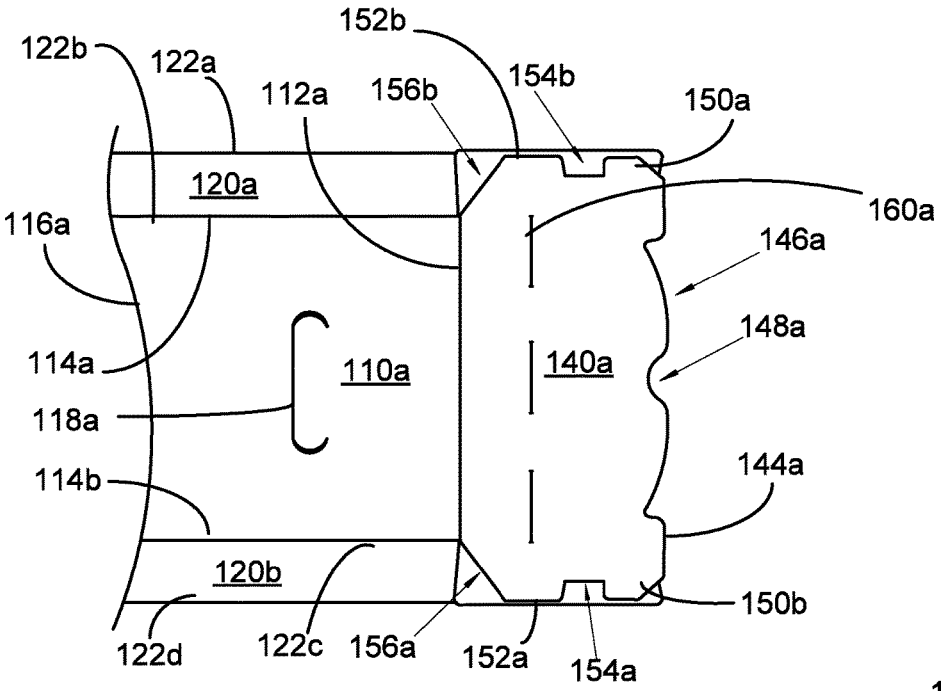
FIG. 3 illustrates a top view of the semiregular polyhedron box collapsed, showing one end of the irregular panels adjacent to a square sidewall, in accordance with an embodiment of the present invention.

As FIG. 3 illustrates, rectangular sidewalls 102*a-b* are generally rectangular in shape and elongated. Rectangular sidewalls 102*a-b* are defined by a rectangular upper edge 104*a*, 104*b*, a rectangular lower edge 108*a*, 108*b*, and two rectangular lateral edges 106*a*, 106*b*, 106*c*, 106*d*. In one embodiment, the rectangular sidewalls 102*a-b* are disposed in a spaced-apart, parallel relationship.

Figure 4:
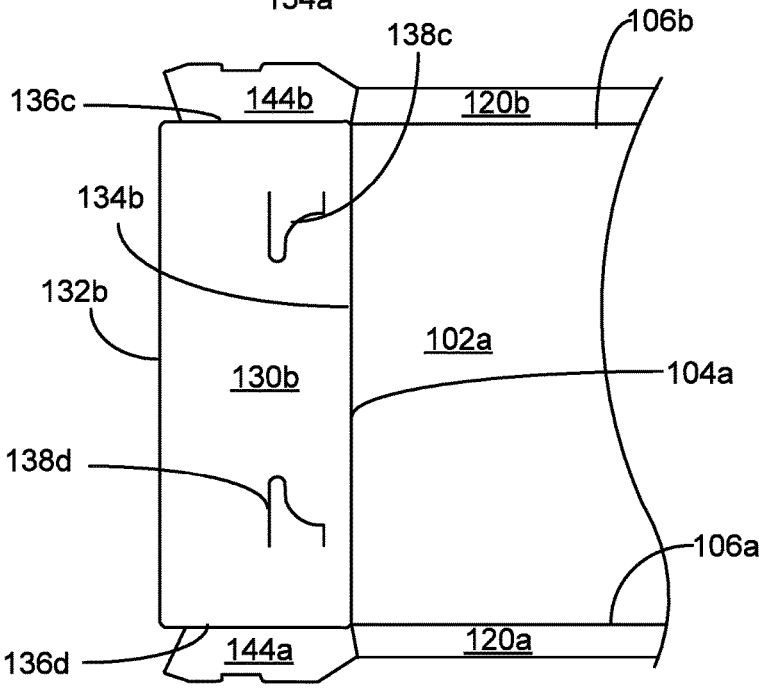
FIG. 4 illustrates a top view of the semiregular polyhedron box collapsed, showing one end of the rectangular panel adjacent to a rectangular sidewall, in accordance with an embodiment of the present invention.

As shown in FIG. 4, two square sidewalls 110*a*, 110*b* are defined by a square upper edge 112*a*, 112*b*, a square lower edge 116*a*, 116*b*, and two square lateral edges 114*a*, 114*b*, 114*c*, 114*d*. Two square sidewalls 110*a-b* are generally square in shape. In one embodiment, square sidewalls 110*a*, 110*b* are disposed in a spaced-apart, parallel relationship from each other, and in a generally perpendicular relationship to rectangular sidewalls 102*a*, 102*b*.

In one embodiment, square sidewalls 110*a-b* are defined by at least one handle aperture 118*a*, 118*b*. In another embodiment, two handle apertures 118*a-b* may be elongated, so as to receive a hand for gripping the box 100 by each square sidewalls 110*a-b*. Each square sidewall 110*a*, 110*b* has a corresponding handle aperture 118*a*, 118*b* to enable lifting the box 100 from both sides.

Figure 5:
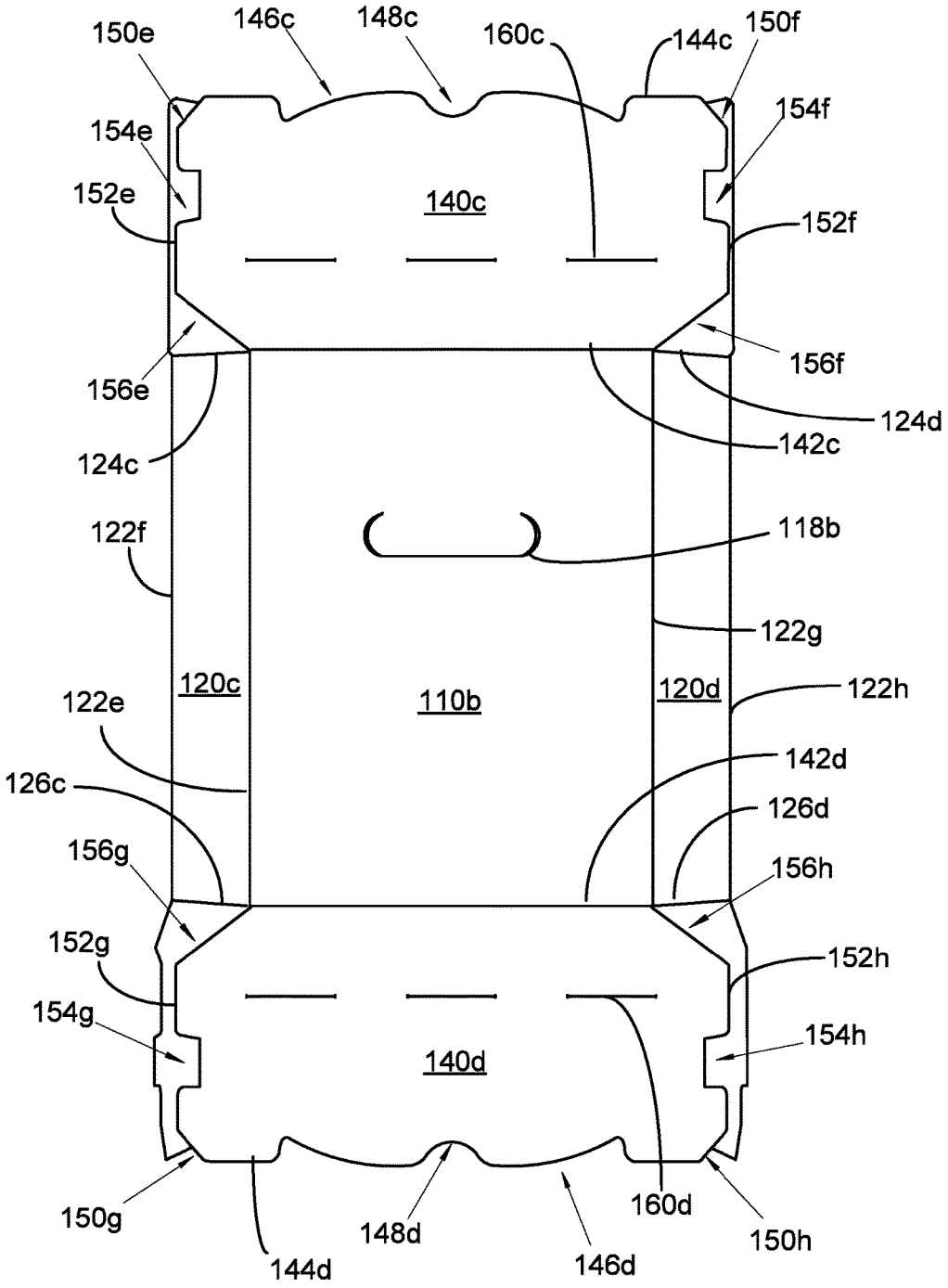
FIG. 5 illustrates a top view of the semiregular polyhedron box collapsed, showing both irregular panels, in accordance with an embodiment of the present invention.

Turning now to FIG. 5, four corner sidewalls 120*a*, 120*b*, 120*c*, 120*d* are defined by a corner upper edge 124*a*, 124*b*, 124*c*, 124*d* a corner lower edge 126*a*, 126*b*, 126*c*, 126*d* and two corner lateral edges 122*a*, 122*b*, 122*c*. 122*d*, 122*e*, 122*f*, 122*g*, 122*h* that are substantially longer than the corner upper edge and the corner lower edge. Corner sidewalls 120*a-d* are disposed between the two rectangular sidewalls 102*a*, 102*b* and the two square sidewalls 110*a*, 110*b*. Corner sidewalls 120*a-d* are generally narrow and elongated, forming the corner region of the entire sidewall arrangement.

Figure 6:
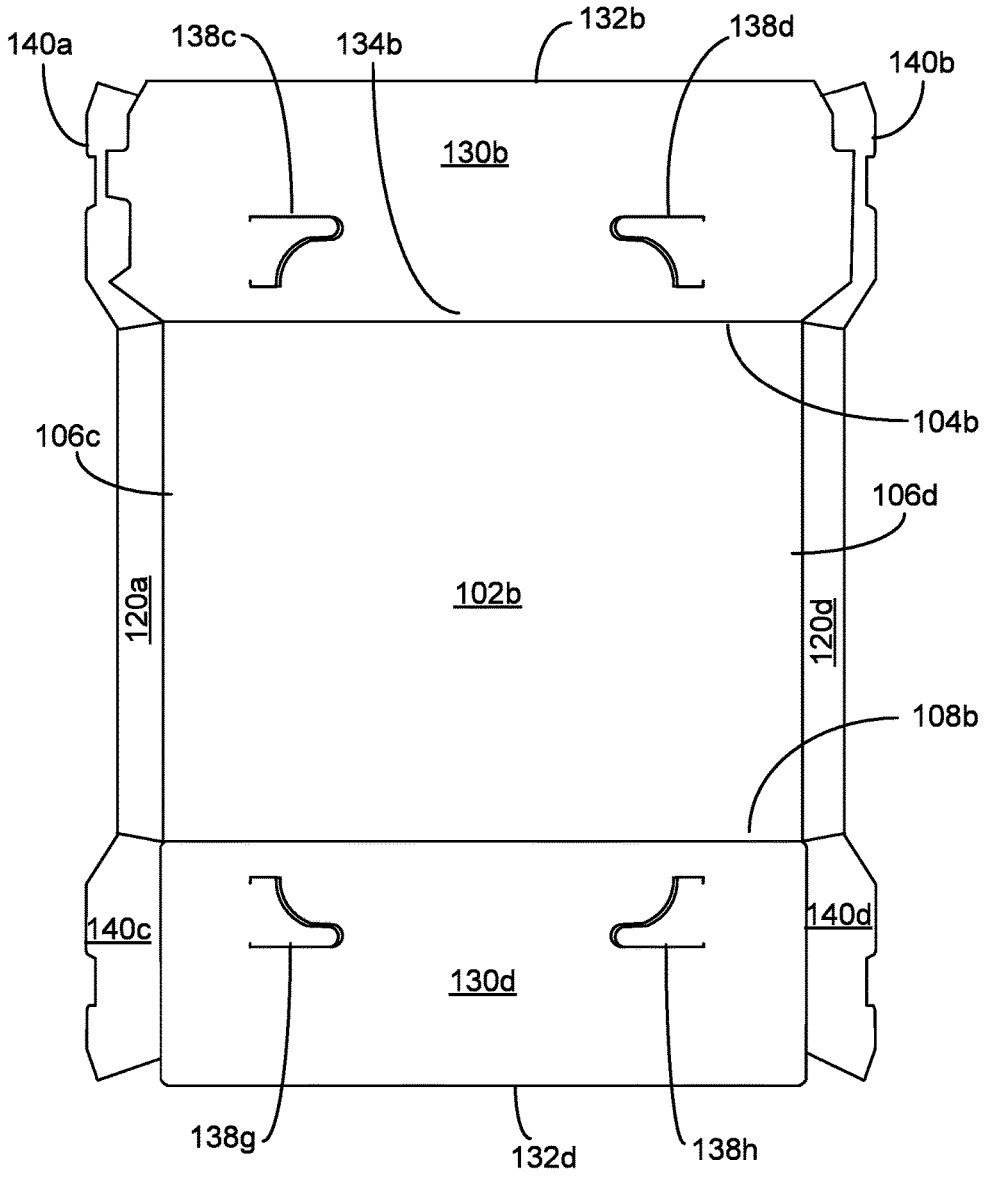
FIG. 6 illustrates a perspective side view of the semiregular polyhedron box folded so that the rectangular sidewalls are coplanar and the square sidewalls are coplanar, in accordance with an embodiment of the present invention.

As box 100 begins to take form in FIG. 6, it is shown how sidewalls 102*a-b*, 110*a-b*, 120*a-d* join at their lateral edges 106*a-d*, 114*a-d*, 122*a-h* to form an enclosed region 128. Enclosed region is defined by a generally rectangular shape and four chamfered edges 158*a-d*. As discussed above, each corner sidewall 120*a-d*, which is generally narrow, is disposed between the wider rectangular and square sidewalls 102*a-b*, 110*a-b*. In this manner, sidewalls 102*a-b*, 110*a-b*, 120*a-d* join at their respective lateral edges to form an enclosed region 128 defined by a generally rectangular shape and having four chamfered edges 130*a-d*.

Figure 7:
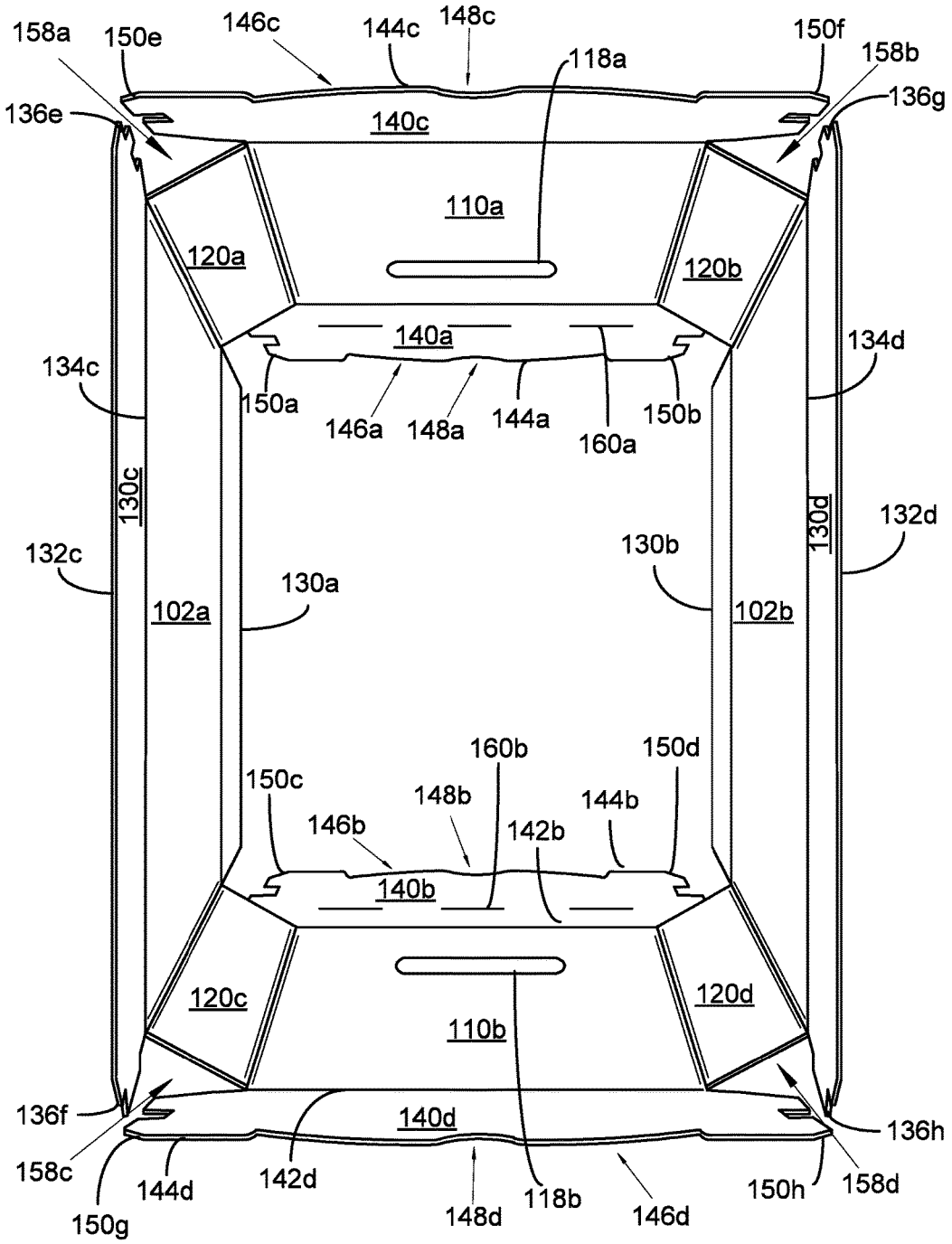
FIG. 7 illustrates a top view of the semiregular polyhedron box folded so that the rectangular sidewalls are coplanar and the square sidewalls are coplanar, in accordance with an embodiment of the present invention.

It is significant to note that chamfered edges 130*a-d*, as taught in the box 100, are generally symmetrically sloped corners to the sidewalls that distribute weight uniformly, resist puncturing, and increase the volume of the enclosed region 128 in the box 100. It is corner sidewalls 158*a-d* that substantially form the chamfered edges 158*a-d*. FIG. 7 illustrates the relative position of the chamfered edges 130*a-d*, showing symmetry around the perimeter of the box 100.

In some embodiments, four rectangular panels 130*a*, 130*b*, 130*c*, 130*d* and four irregular panels 140*a*, 140*b*, 140*c*, 140*d* form the top and bottom hinged surfaces for closing the enclosed region 128 that is formed by sidewalls 102*a-b*, 110*a-b*, 120*a-d*. In one embodiment, the rectangular panel 130*a* hingedly joins with two opposing rectangular upper 104*a* and lower edges 108*a* of the rectangular sidewalls 102*a*. Two rectangular panels 130*a*, 130*b* hinge off the rectangular upper edges 104*a*, and two rectangular panels 130*c*, 130*d* hinge about the rectangular lower edges 108*b*.

Figure 8:
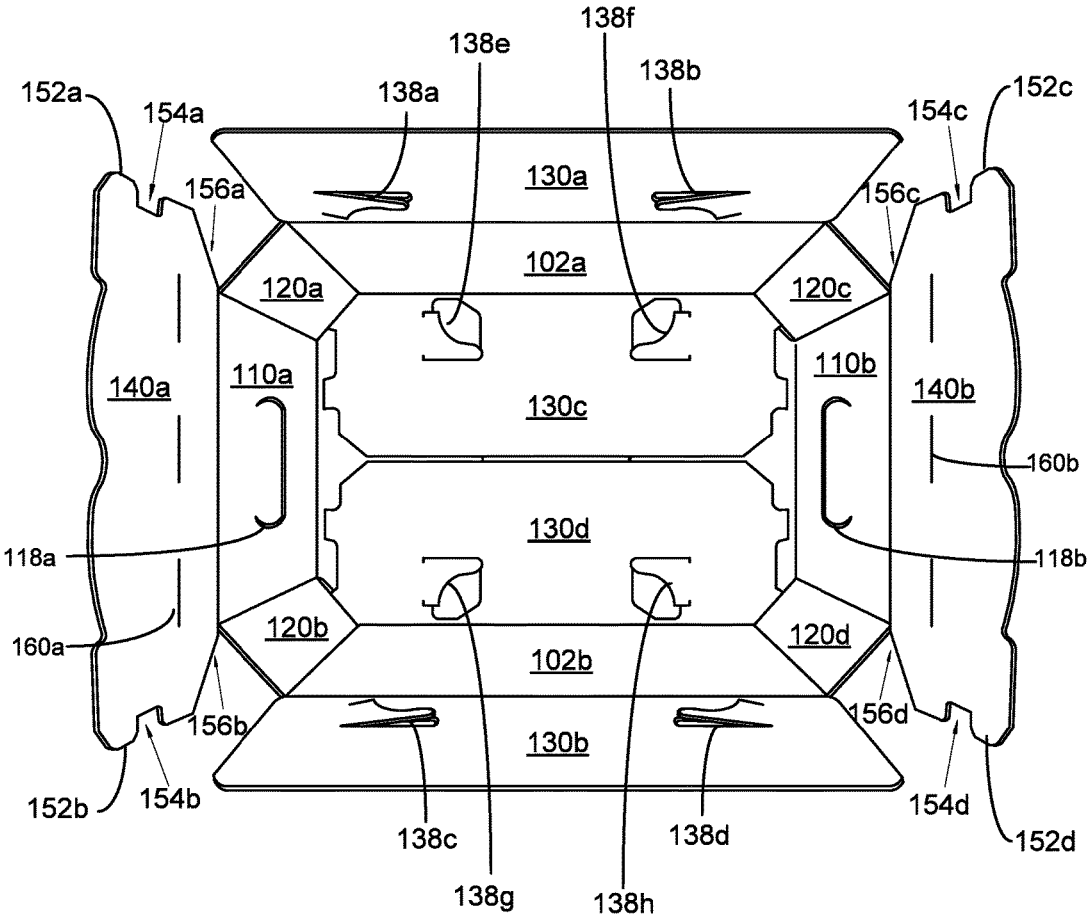
FIG. 8 illustrates a top view of the semiregular polyhedron box folded out and having two irregular panels interlocked with two rectangular panels, in accordance with an embodiment of the present invention.

As FIG. 8 illustrates, each rectangular panel 130*a-d* is defined by a straight top edge 132*a*, 132*b*, 132*c*, 132*d* a pair of straight lateral edges 136*a*, 136*b*, 136*c*, 136*d*, 136*e*, 136*f*, 136*g*, 136*h* and a straight bottom edge 134*a*, 134*b*, 134*c*, 134*d*. In some embodiments, all the edges 132*a*, 134*a*, 136*a-b* of rectangular panel 130*a* are substantially straight. The straight bottom edge 134*a* hingedly joins the upper and lower rectangular edge 104*a*, 108*a* of rectangular sidewall 102*a*. This hinged junction occurs at both the top and bottom end of box 100.

Each rectangular panel 130*a* is further defined by two L-shaped slots 138*a*, 138*b* that are disposed in a spaced apart relationship. L-shaped slots 138*a-b* form centrally in the rectangular panel 130*a*, serving as a key component for interlocking the panels 130*a*, 140*a* together. Further, the generally L-shape of the slot 138*a-h* creates a snug, friction fit relationship with the lateral notch 154*a-h* and top angled corner 150*a-h* of the irregular panels 140*a*, 140*b*, 140*c*, 140*d*, as described below.

Figure 9:
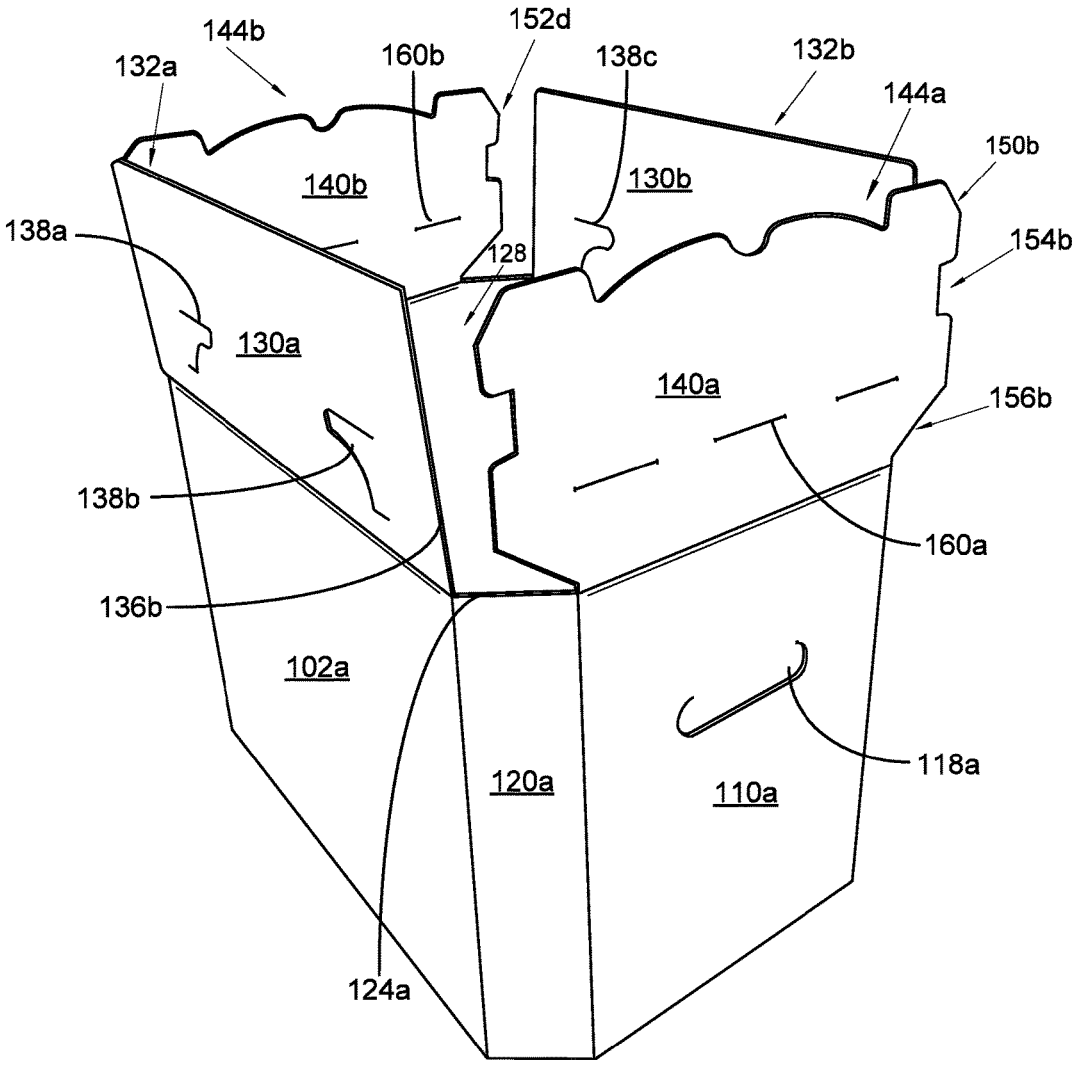
FIG. 9 illustrates a perspective view of the semiregular polyhedron box folded out and having two irregular panels interlocked with two rectangular panels, in accordance with an embodiment of the present invention.

Turning now to FIG. 9, four irregular panels 140*a*, 140*b*, 140*c*, 140*d* hingedly join with two opposing square upper edges 112*a-b* of the two square sidewalls 110*a*, 110*b* and two opposing square lower edges 116*a*, 116*b* of the two square sidewalls 110*a-b*. Each irregular panel 140*a-d* is defined by an irregular bottom edge 142*a*, 142*b*, 142*c*, 142*d* that hingedly joins the upper edge 112*a-b* or the lower edge 116*a-b* of the square sidewall 110*a-b*. Each irregular panel 140*a-d* is further defined by an irregular top edge 144*a*, 144*b*, 144*c*, 144*d* having a convex curve 146*a*, 146*b*, 146*c*, 146*d*.

In some embodiments, a central notch 148*a*, 148*b*, 148*c*, 148*d* may form in the middle of the curve 146*a-d* to provide a space for a finger to manipulate the irregular top edge 144*a*, 144*b*. Irregular top edge 144*a-d* also has a pair of top angled corners 150*a*, 150*b*, 150*c*, 150*d*, 150*e*, 150*f*, 150*g*, 150*h*.

Further, each irregular panel 140*a-d* is defined by a pair of irregular lateral edges 152*a*, 152*b*, 152*c*, 152*d*, 152*e*, 152*f*, 152*g*, 152*h*. A lateral notch 154*a*, 154*b* may form along irregular lateral edges 152*a-h*. Lateral notch 154*a-b* may follow a generally square shape. Irregular lateral edges 152*a*, 152*b* terminate at a pair of bottom angled corners 156*a*, 156*b*, 156*c*, 156*d*, 156*e*, 156*f*, 156*g*, 156*h*. Bottom angled corners 156*a-h* may form a symmetrically sloped corner.

Figure 10:
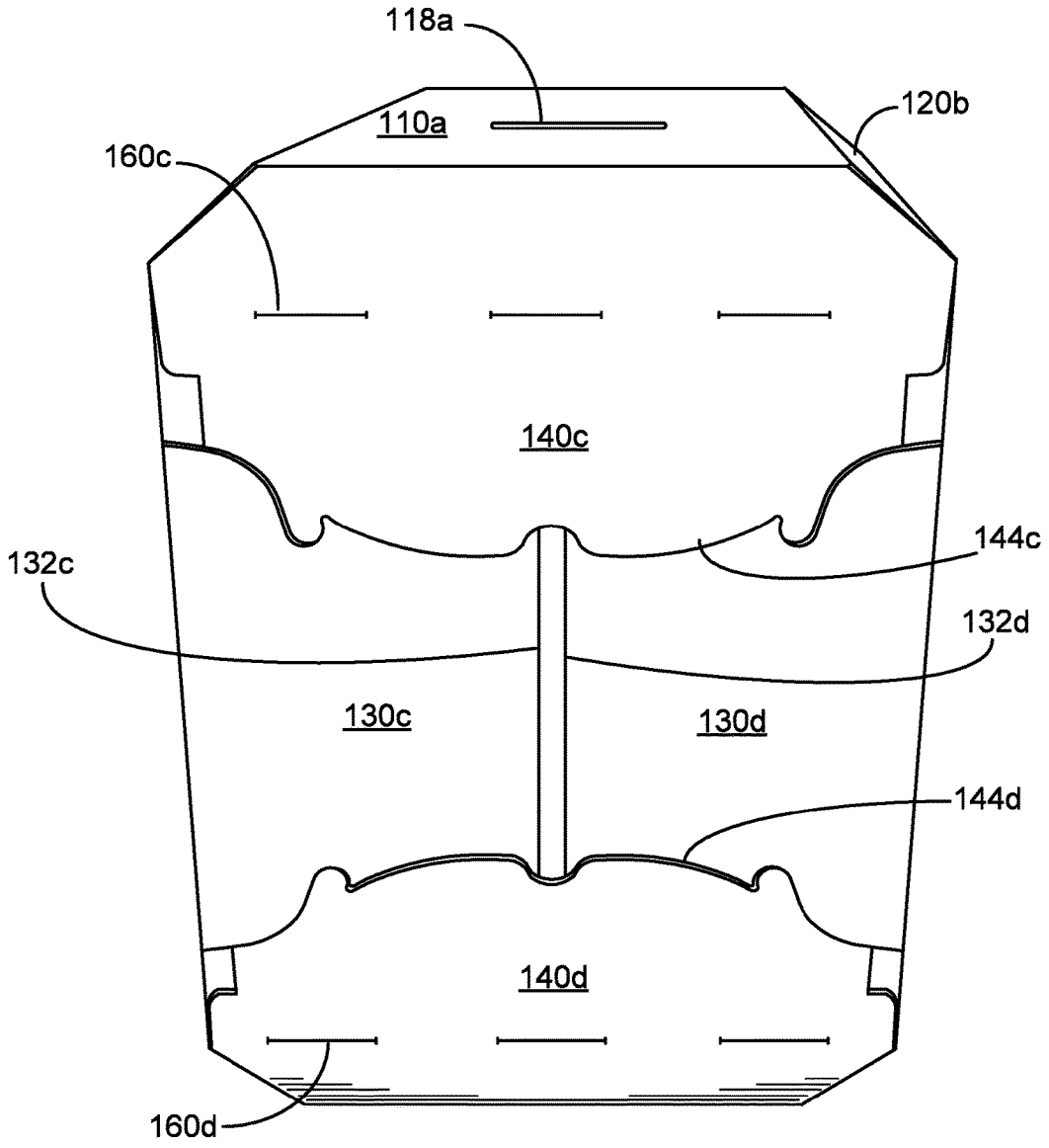
FIG. 10 illustrates a bottom view of the semiregular polyhedron box folded out and having two irregular panels interlocked with two rectangular panels, in accordance with an embodiment of the present invention.

In this manner, the pair of top angled corners 150*a-b* of the irregular top edge 144*a* and the lateral notch 154*a* are sized and dimensioned to interlock with L-shape slots 138*a* of the rectangular panel 130*a* to temporarily close the box 100. This interlocking relationship may include a friction fit, snug interaction between the surface areas on slot 138*a*, of top angled corners 150*a*, and lateral notch 154*a*. FIG. 10 shows a close up of the interlocking notches 154*a* and slots 138*a* from the bottom view of the box 100.

In some embodiments, four irregular panels 140*a*, 140*b*, 140*c*, 140*d* may further be defined by an elongated perforation 160*a*, 160*b*, 160*c*, 160*d* disposed lengthwise to enable folding. Elongated perforation 160*a* is generally more proximal to the irregular bottom edge 142*a* than the irregular top edge 144*a*. This folding manipulation facilitates interlocking the panels during assemblage of the box 100. For example, irregular panels 140*a*, 140*b*, 140*c*, 140*d* can be curved out when the object in the box 100 is large. Also, perforations 160*a-b* allows for more flexible manipulations when interlocking the slots and the notch.

Figure 11:
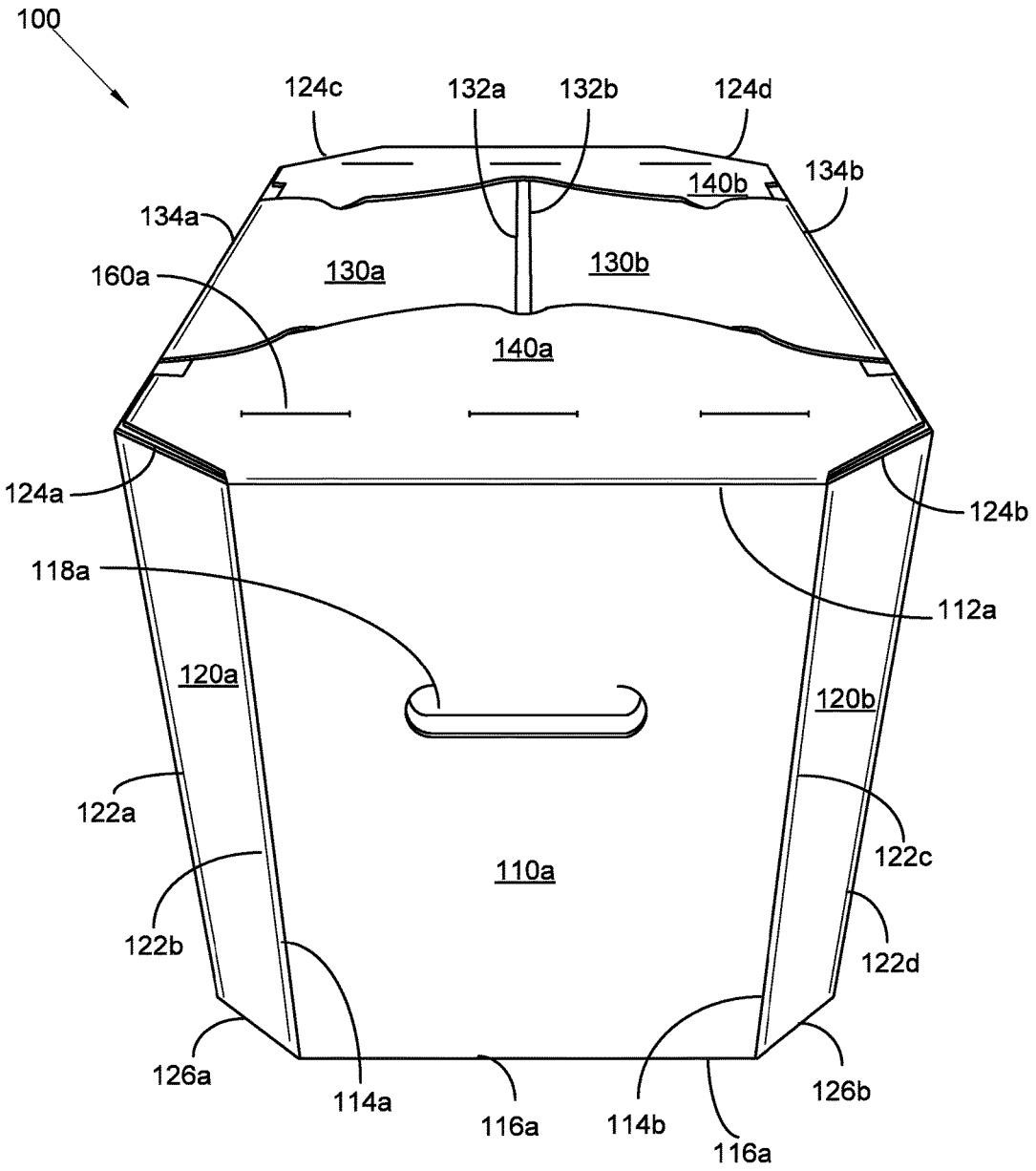
FIG. 11 illustrates a perspective view of the semiregular polyhedron box fully constructed with two rectangular panels and two irregular panels interlocked, in accordance with an embodiment of the present invention.
Figure 12:
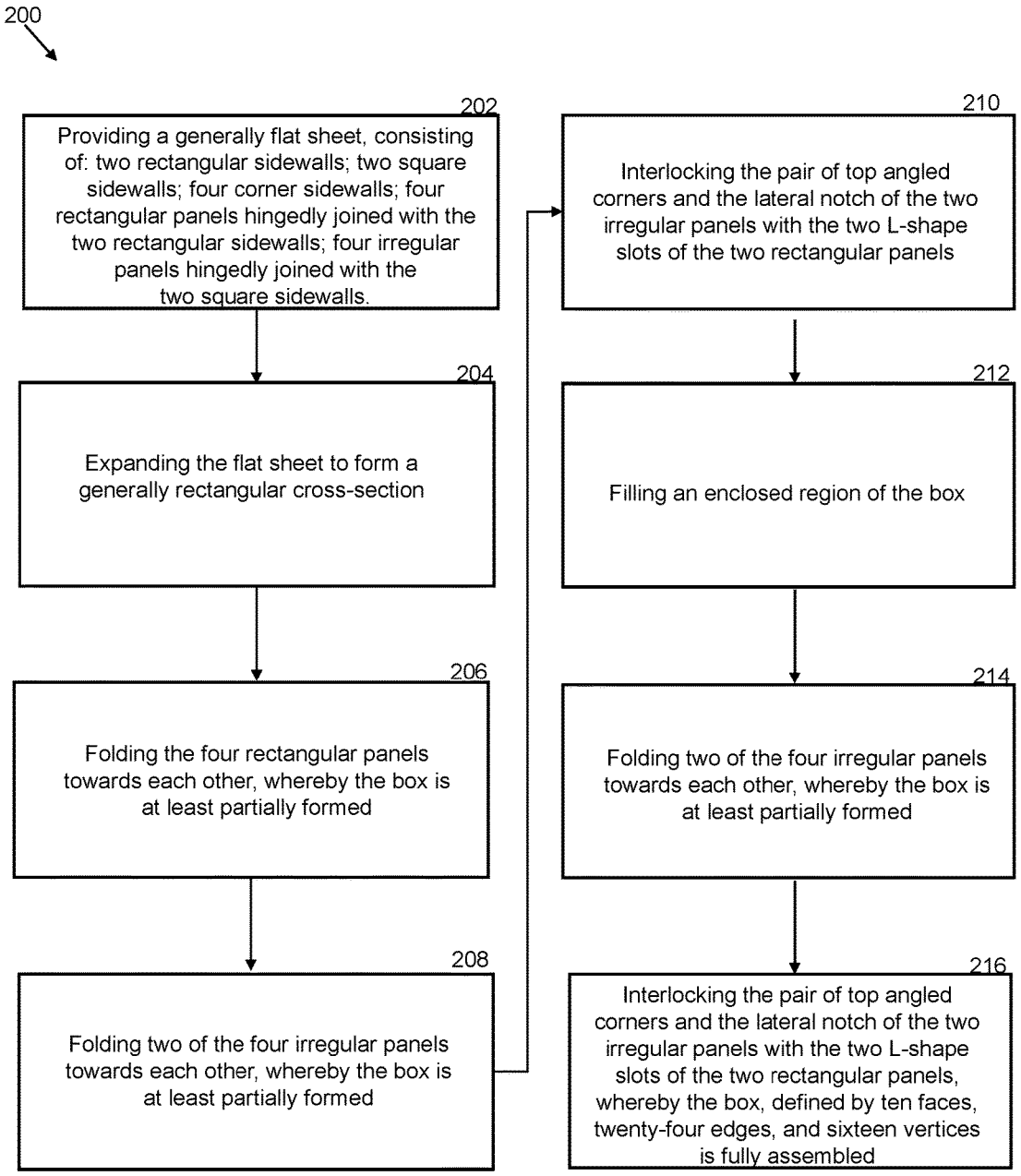
FIG. 12 illustrates a flowchart of an exemplary method for assembling a semiregular polyhedron box, in accordance with an embodiment of the present invention.

FIG. 11 illustrates the fully assembled semiregular polyhedron box. As discussed above, the unique interlocking slots and notches enhance the structural integrity of box 100. The construction of box 100 is illustrated in FIG. 12, which shows a flowchart of an exemplary method 200 for assembling a semiregular polyhedron box 100.

As shown back in FIG. 2, the sidewalls, panels, and interlocking mechanisms of box 100 are flat when box 100 is collapsed. However, when fully assembled, the box 100 forms a generally rectangular cross-section. Method 200 for assembly is relatively straight forward, as the box 100 is manipulated to a generally rectangular, upright position, the panels on both open ends are folded down and interlocked through use of an irregular edge having a notch, and an L-shaped slot.

In some embodiments, method 200 may include an initial Step 202 of providing a generally flat sheet, the flat sheet consisting of: two rectangular sidewalls 102*a*, 102*b*; two square sidewalls 110*a*, 110*b*; and four corner sidewalls 120*a*, 120*b*, 120*c*, 120*d*, whereby the two rectangular sidewalls 102*a*, 102*b*, the two square sidewalls 110*a*, 110*b*, the four corner sidewalls 120*a*, 120*b*, 120*c*, 120*d* are adapted to form a generally rectangular cross-section; four rectangular panels 130*a*, 130*b*, 130*c*, 130*d* hingedly joined with the two rectangular sidewalls 102*a*, 102*b*, the four rectangular panels 130*a*, 130*b*, 130*c*, 130*d* defined by two L-shaped slots; and four irregular panels 140*a*, 140*b*, 140*c*, 140*d* hingedly joined with the two square sidewalls 110*a*, 110*b*, the four irregular panels 140*a*, 140*b*, 140*c*, 140*d* defined by an irregular top edge having a convex curve, a central notch, and a pair of top angled corners.

The method 200 may further comprise a Step 204 of expanding the flat sheet to form a generally rectangular cross-section. A Step 206 includes folding the four rectangular panels 130*a-d* towards each other, whereby the box 100 is at least partially formed. A Step 208 comprises folding two of the four irregular panels 140*a*, 140*b*, 140*c*, 140*d* towards each other, whereby the box 100 is at least partially formed.

In some embodiments, a Step 210 includes interlocking the pair of top angled corners 150*a*, 150*b* and the lateral notch 154*a*, 154*b* of the two irregular panels 140*a*, 140*b* with the two L-shape slots 138*a*, 138*b* of the two rectangular panels 130*a*. In some embodiments, a Step 212 may include filling the enclosed region 128 of the box 100 with an object. The object may include a heavy object, or a fragile object, commonly contained in bankers boxes and corrugated boxes.

A Step 214 comprises folding two of the four irregular panels 140*a-d* towards each other, whereby the box 100 is at least partially formed. An elongated perforation 160*a-b* helps in the folding of the irregular panel 140*a-d*. A final Step 216 includes interlocking the pair of top angled corners and the lateral notch of the two irregular panels 140*a*, 140*b*, 140*c*, 140*d* with the two L-shape slots of the two rectangular panels 130*a*, 130*b*, 130*c*, 130*d*, whereby the box 100 is fully assembled and defined by ten faces, twenty-four edges, and sixteen vertices.

These and other advantages of the invention will be further understood and appreciated by those skilled in the art by reference to the following written specification, claims and appended drawings.

Because many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A semiregular polyhedron box, the box comprising:

two rectangular sidewalls defined by a rectangular upper edge, a rectangular lower edge, and two rectangular lateral edges;

two square sidewalls defined by a square upper edge, a square lower edge, and two square lateral edges;

four corner sidewalls defined by a corner upper edge, a corner lower edge, and two corner lateral edges that are substantially longer than the corner upper edge and the corner lower edge, the four corner sidewalls being disposed between the two rectangular sidewalls and the two square sidewalls, whereby the sidewalls join at the respective lateral edges to form an enclosed region defined by a generally rectangular shape and having four chamfered edges;

four rectangular panels hingedly joined with two opposing rectangular upper edges and two opposing rectangular lower edges of the two rectangular sidewalls, each rectangular panel defined by a straight top edge, a pair of straight lateral edges, and a straight bottom edge, the straight bottom edge hingedly joined with the rectangular upper edge of the two rectangular sidewalls, each rectangular panel further defined by two L-shaped slots that are centrally disposed in a spaced apart relationship; and four irregular panels hingedly joined with two opposing square upper edges and two opposing square lower edges of the two square sidewalls, each irregular panel defined by an irregular bottom edge hingedly joined with the square upper edge of the square sidewall, each irregular panel further defined by an irregular top edge having a convex curve and a pair of top angled corners, each irregular panel further defined by a pair of irregular lateral edges having a lateral notch and a pair of bottom angled corners, each irregular panel further defined by an elongated perforation disposed lengthwise, whereby the pair of top angled corners and the lateral notch of the four irregular panels are sized and dimensioned to detachably interlock with the two L-shape slots of the four rectangular panels.

2. The box of claim 1, wherein the sidewalls and panels are plastic corrugated material.

3. The box of claim 1, wherein the four corner sidewalls are narrow and elongated.

4. The box of claim 1, wherein the two square sidewalls are defined by at least one handle aperture.

5. The box of claim 1, wherein the central notch and the lateral notch have a generally square shape.

6. The box of claim 1, wherein the irregular top edge of the four irregular panels are defined by a central notch.

7. The box of claim 1, wherein the elongated perforation is disposed proximal to the irregular bottom edge of the four irregular panels.

8. The box of claim 1, wherein the box is adapted to form a generally rectangular or square cross-section with all sidewalls and panels being generally flat.

9. The box of claim 1, wherein the shape of the box is rectangular or square.

10. The box of claim 1, wherein the box comprises about ten faces, twenty-four edges, and sixteen vertices.

11. A semiregular polyhedron box, the box consisting of:

two rectangular sidewalls defined by a rectangular upper edge, a rectangular lower edge, and two rectangular lateral edges, the two rectangular sidewalls being corrugated;

two square sidewalls defined by a square upper edge, a square lower edge, and two square lateral edges, the two square sidewalls further being defined by at least one handle aperture, the two square sidewalls being corrugated;

four corner sidewalls defined by a corner upper edge, a corner lower edge, and two corner lateral edges that are substantially longer than the corner upper edge and the corner lower edge, the four corner sidewalls being disposed between the two rectangular sidewalls and the two square sidewalls, the four corner sidewalls being corrugated, whereby the sidewalls join at the respective lateral edges to form an enclosed region defined by a generally rectangular shape and having four chamfered edges;

four rectangular panels hingedly joined with two opposing rectangular upper edges and two opposing rectangular lower edges of the two rectangular sidewalls, each rectangular panel defined by a straight top edge, a pair of straight lateral edges, and a straight bottom edge, the straight bottom edge hingedly joined with the rectangular upper edge of the two rectangular sidewalls, each rectangular panel further defined by two L-shaped slots that are centrally disposed in a spaced apart relationship; and four irregular panels hingedly joined with two opposing square upper edges and two opposing square lower edges of the two square sidewalls, each irregular panel defined by an irregular bottom edge hingedly joined with the square upper edge of the square sidewall, each irregular panel further defined by an irregular top edge having a convex curve, a central notch, and a pair of top angled corners, each irregular panel further defined by a pair of irregular lateral edges having a lateral notch and a pair of bottom angled corners, each irregular panel further defined by an elongated perforation disposed lengthwise, the elongated perforation being disposed proximal to the irregular bottom edge of the four irregular panels, whereby the pair of top angled corners and the lateral notch of the four irregular panels are sized and dimensioned to detachably interlock with the two L-shape slots of the four rectangular panels, whereby the box forms about ten faces, twenty-four edges, and sixteen vertices.

12. The box of claim 11, wherein the box comprises a generally rectangular cross-section with all sidewalls and panels being generally flat.

13. The box of claim 11, wherein the shape of the box is rectangular or square.

14. The box of claim 11, wherein the four corner sidewalls are narrow and elongated.

15. The box of claim 11, wherein the at least one handle aperture is elongated.

16. The box of claim 11, wherein the central notch has a generally square shape.

17. The box of claim 11, wherein the lateral notch has a generally square shape.

18. A method for assembling a semiregular polyhedron box, the method comprising:

providing a generally flat sheet, the flat sheet consisting of:

two rectangular sidewalls;

two square sidewalls;

four corner sidewalls, whereby the two rectangular sidewalls, the two square sidewalls, and the four corner sidewalls are adapted to form a generally rectangular cross-section;

four rectangular panels hingedly joined with the two rectangular sidewalls, the four rectangular panels defined by two L-shaped slots slots that are centrally disposed in a spaced apart relationship;

four irregular panels hingedly joined with the two square sidewalls, the four irregular panels defined by an irregular top edge having a convex curve, a central notch, and a pair of top angled corners;

expanding the flat sheet to form a generally rectangular cross-section;

folding the four rectangular panels towards each other, whereby the box is at least partially formed;

folding two of the four irregular panels towards each other, whereby the box is at least partially formed;

interlocking the pair of top angled corners and the lateral notch of the two irregular panels with the two L-shape slots of the two rectangular panels;

filling an enclosed region of the box with an object;

folding two of the four irregular panels towards each other, whereby the box is at least partially formed; and interlocking the pair of top angled corners and the lateral notch of the two irregular panels with the two L-shape slots of the two rectangular panels, whereby the box is fully assembled and defined by ten faces, twenty-four edges, and sixteen vertices.

* * * * *